US005201157A

United States Patent [19]

Thornton et al.

[11] Patent Number: 5,201,157

[45] Date of Patent: Apr. 13, 1993

[54] POLE TOP COVER EXPANDABLE BRACKET ASSEMBLY

[75] Inventors: Gerry F. Thornton, Blacksburg; Thomas D. Hirt, Christiansburg, both of Va.

[73] Assignee: Hubbell Incorporated, Orange, Conn.

[21] Appl. No.: 852,290

[22] Filed: Mar. 16, 1992

[51] Int. Cl.[5] ..... E04H 12/00

[52] U.S. Cl. ..... 52/301; 49/465; 220/325

[58] Field of Search ..... 52/301, 217; 256/DIG. 5; 49/465; 220/323, 325; 292/19, 20, 43, 256.67

[56] References Cited

U.S. PATENT DOCUMENTS

| | | | |
|---|---|---|---|
| 609,569 | 8/1898 | Berchtold | 220/323 |
| 1,015,907 | 1/1912 | Ryder | 292/19 |
| 1,192,745 | 7/1916 | Brown | 220/323 |
| 2,998,110 | 8/1961 | Hutzelman | 52/301 |
| 3,585,770 | 6/1971 | Maizler | 52/217 |
| 4,761,319 | 8/1988 | Kraus et al. | 49/465 |
| 4,964,659 | 10/1990 | Baldwin | 220/323 |

FOREIGN PATENT DOCUMENTS

| | | | |
|---|---|---|---|
| 264944 | 2/1927 | United Kingdom | 220/325 |

*Primary Examiner*—Carl D. Friedman
*Assistant Examiner*—Christopher Todd Kent
*Attorney, Agent, or Firm*—Jerry M. Presson; Michael R. Swartz

[57] ABSTRACT

A pole top cover assembly includes a generally flat cover plate adapted to overlie an open top end of a tubular hollow pole, an elongated arcuate-shaped bracket formed of yieldably resilient, semi-rigid, semi-flexible deformable material and being disposable along one side of the cover plate, and an elongated fastener rotatably mounted through both an aperture in the cover plate and a hole in the bracket and having external threads threadably engaged with portions of the plate and bracket which form the respective aperture and hole thereof. Rotation of the fastener in one direction relative to the cover plate and bracket causes the arcuate-shaped bracket to engage the plate and to deform and draw toward the one side of the cover plate and thereby expand in length and forcibly engage at opposite ends with portions of an interior surface of the hollow tubular pole so as to retain the cover plate on the pole top end. Rotation of the fastener in an opposite direction relative to the cover plate and bracket permits the arcuate-shaped bracket to engage the plate and to reform and retract away from the one side of the cover plate and thereby contract in length and disengage at the opposite ends from the portions of the interior surface of the hollow tubular pole so as to release the cover plate from the pole top end.

10 Claims, 1 Drawing Sheet

POLE TOP COVER EXPANDABLE BRACKET ASSEMBLY

BACKGROUND OF THE INVENTION

1. Field of the Invention

The present invention generally relates to a cover assembly for an open top of a hollow tubular pole and, more particularly, is concerned with a pole top cover expandable bracket assembly.

2. Description of the Prior Art

Hollow tubular metal poles having open top ends are widely used to support lighting at various locations and sites. Cover assemblies are typically attached over the open top ends of the poles to prevent entry of moisture and dirt into the interior thereof. One prior art example of such cover assembly includes a flat plate and a plurality of spring clips mounted about the periphery of the plate. To attach the cover assembly to the top end of the pole, the spring clips are inserted over the upper edge of the pole and interfit with an annular groove defined about the interior surface of the pole at a location spaced below the upper edge thereof.

This prior art cover assembly has certain drawbacks which inhibit its acceptability as an adequate means for covering the open top ends of the poles. One drawback is the difficulty of adjusting the spring clips to ensure that they properly fit or seat with the pole groove. Another drawback is the overall complexity and cost of the construction of the cover assembly. Still another drawback is the general clumsiness users tend to experience in handling the cover assembly during installation thereof on the open top end of the pole.

Consequently, a need exists to provide a pole top cover assembly with a construction which can be easily handled and installed so as to eliminate the above-described drawbacks of the prior art pole cover assembly.

SUMMARY OF THE INVENTION

The present invention provides a pole top cover assembly designed to satisfy the aforementioned needs. The pole top cover assembly of the present invention permits easy installation or removal thereof through feel only by employing an expandable and contractible bracket and a fastener for retaining the bracket along an interior side of a cover plate which is hidden from view during the installation or removal of the cover assembly to or from an open top end of an elongated hollow tubular pole.

Accordingly, the present invention is directed to a cover assembly for an open top of an elongated tubular hollow pole which comprises: (a) a cover plate adapted to overlie the open top end of the tubular hollow pole and having a portion with an aperture formed therethrough; (b) a bracket formed of yieldably resilient, semi-rigid, semi-flexible deformable material and having an elongated arcuate shape, the bracket being disposable along one side of the cover plate, the bracket having opposite ends and a portion with a hole formed therethrough; and (c) an elongated fastener rotatably mounted through both the aperture of the cover plate and the hole of the bracket and having external threads threadably engaged with the portions of the cover plate and bracket forming the respective aperture and hole thereof. Rotation of the externally threaded fastener in one direction relative to the cover plate and the bracket causes the arcuate-shaped bracket to engage the plate and to deform and draw toward the one side of the cover plate and thereby expand in length and forcibly engage at opposite ends of the bracket with portions of an interior surface of the hollow tubular pole so as to retain the cover plate on the pole top end. Rotation of the externally threaded fastener in an opposite direction relative to the cover plate and the bracket permits the arcuate-shaped bracket to engage the plate and to reform and retract away from the one side of the cover plate and thereby contract in length and disengage at the opposite ends of the bracket from the portions of the interior surface of the hollow tubular pole so as to release the cover plate from the pole top end.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, wherein like reference characters designate like or corresponding parts throughout the several views, reference will be made to the attached drawings in which.

DETAILED DESCRIPTION OF THE INVENTION

Figure 2:
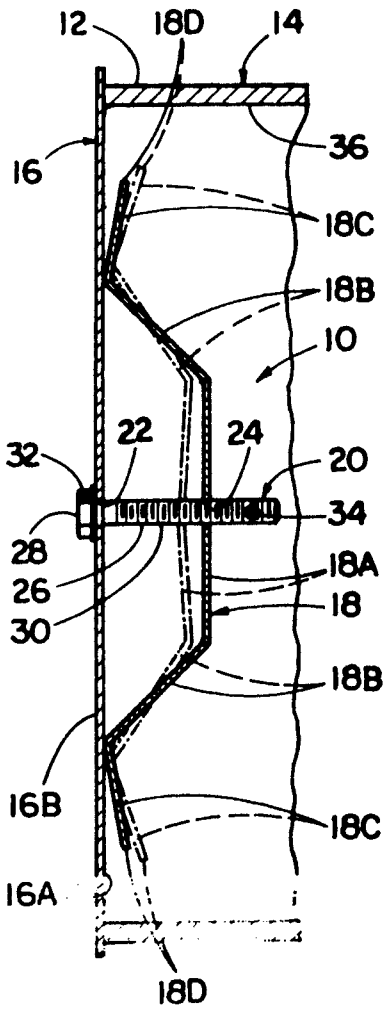
FIG. 2 is a cross-sectional view of the pole top cover assembly taken along line 2—2 of FIG. 1, showing respective disengaged and engaged positions of a deformable bracket of the assembly.
Figure 1:
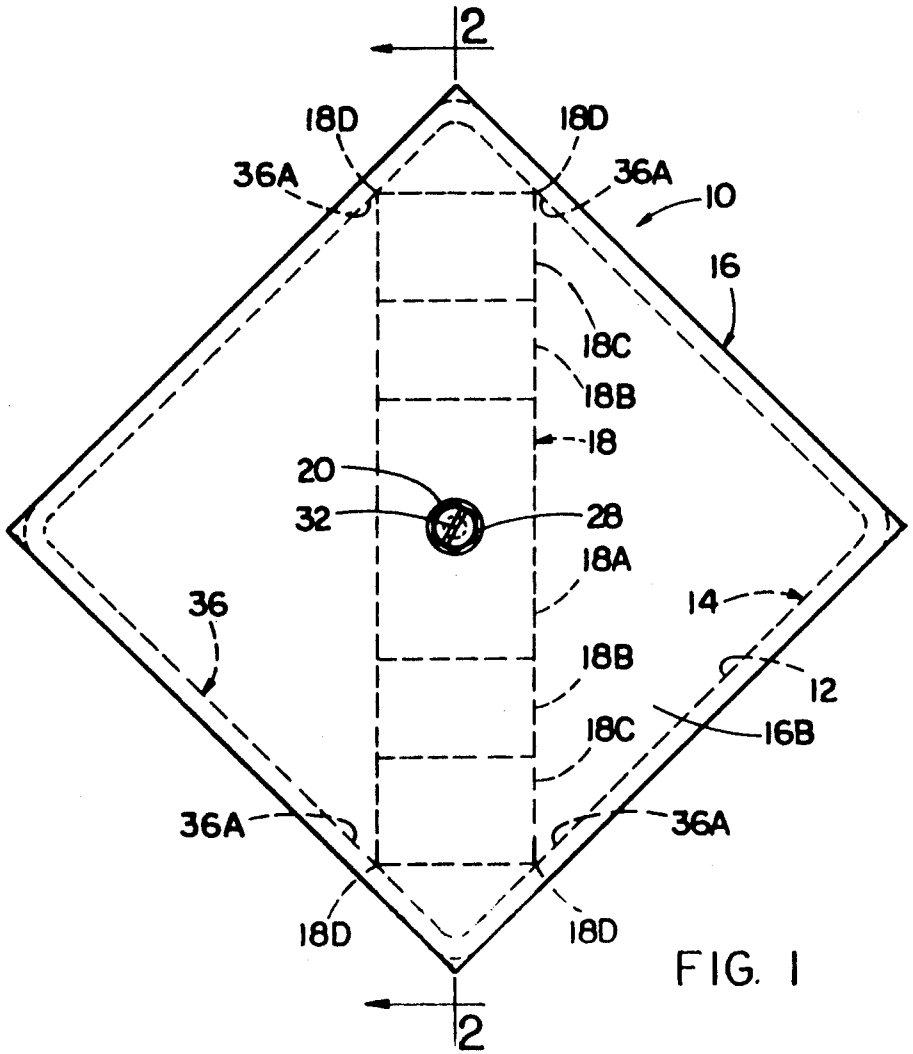
FIG. 1 is an exterior top plan view of a pole top cover assembly of the present invention installed on an open top end of a hollow tubular pole.

Referring now to FIGS. 1 and 2 of the drawings, there is a pole top cover assembly, generally designated 10, of the present invention installed on an open top end 12 of an elongated hollow tubular pole 14, having a construction widely used to support lighting at various locations and sites. In the illustrated embodiment, the hollow tubular pole 14 is rectangular or square in cross-sectional, although it can equally have a circular cross-sectional shape.

Basically, the pole top cover assembly 10 includes a generally flat cover plate 16, an elongated arcuate-shaped bracket 18, and an elongated screw or fastener 20. The flat cover plate 16 of the assembly 10 has a peripheral configuration (for example, square or circular) substantially the same as the cross-sectional configuration of the tubular hollow pole 14, adapting it to overlie and cover the open top end 12 of the pole 14. The cover plate 16 also has an aperture 22 formed through it at a generally central location.

The elongated bracket 18 of the assembly 10 is formed of a suitable yieldably resilient, semi-rigid, semi-flexible deformable metal material, such as steel or aluminum. In a plan view, the bracket 18 has a generally rectangular configuration, whereas, in a side view, the bracket 18 has an arcuate shape, particularly, a generally shallow W-shaped configuration. The bracket 18 is comprised of a central portion 18A having a hole 24 formed through it at a central location, a pair of opposite intermediate portions 18B connected to and extending in an inclined orientation downwardly and outwardly from opposite ends of the central portion 18A, and a pair of upturned end portions 18C connected to and extending outwardly and upwardly from opposite ends of the respective intermediate portions of the bracket 18. The upturned end portions 18C of the bracket 18 have pairs of corners 18D thereon at the opposite ends of the bracket 18.

The elongated fastener 20 of the assembly 10 includes an elongated shaft portion 26 and an enlarged head portion 28 attached to one end of the shaft portion 26. The shaft portion 26 is rotatably mounted through the central aperture 22 of the cover plate 16 and the central hole 24 of the bracket 18 and has external threads 30 thereon threadably coupled or engaged with portions of the plate 16 and bracket 18 which form the respective aperture 22 and hole 24 thereof. The aperture 22 and hole 24 can be pilots holes or extruded and formed with internal threads. The head portion 28 has a groove 32 adapting it for engagement by a tool, such as a screwdriver, in order to rotate the fastener 20. The fastener 20 disposes the bracket 18 along one side 16A of the cover plate 16, whereas the head portion 28 of the fastener 20 is disposed on the opposite side 16B of the cover plate 16.

When the cover assembly is applied to the open top end 12 of the hollow tubular pole 14 as seen in FIGS. 1 and 2, the flat cover plate 16 overlies the end 12 of the pole 14. The arcuate-shaped bracket 18 is hidden from view below the plate 16 inside of the open top end 12 of the pole 14. The head portion 28 of the fastener 20 is located above the plate 16 where it can be reached by a screwdriver. The shaft portion 26 of the fastener 20 has a stop element 34 in the form of a deformed or pinched portion on its outer end which prevents accidental decoupling of the bracket 18 from the plate 16 which would result in loss of the bracket inside of the pole 14.

Rotation of the fastener 20 in one direction relative to the cover plate 16 and bracket 18 will cause attachment of the cover assembly 10 to the top 12 of the pole 14. A conventional tool, such as a screwdriver, is used to engage with the groove 32 of the head portion 28 to rotate the fastener 20. Such rotation of the fastener 20 causes the bracket 18 to engage against the lower side 16A of the cover plate 16 and to deform and at its central portion 18A to draw toward the lower side 16A of the cover plate which thereby expands the length of the bracket 18 and forcibly engages its opposite corners 18D with spaced portions 36A of the interior surface 36 of the hollow tubular pole 16 so as to retain the cover plate on the pole top end 12. The spaced portions 36A of the interior surface 36 of the hollow tubular pole 16 are located adjacent a pair of the diagonal corners thereof in the case where the pole has a rectangular cross-sectional configuration. The opposite end corners 18D of the bracket 18 can either just frictionally engage or actually slightly pierce into the pole interior surface 36.

Counterrotation of the fastener 20 in an opposite direction relative to the cover plate 16 and bracket 18 will cause release of the cover assembly 10 from the top 12 of the pole 14. The same screwdriver is used to engage the head portion 28 of the fastener 20 and to counterrotate the fastener. Such rotation of the fastener 20 permits the arcuate-shaped bracket 18, which is still engaged with the lower side 16A of the cover plate 16, to reform and retract away from the cover plate 16 which thereby contracts the length of the bracket 18 and disengages its opposite end corners 18D from the spaced portions 36A of the interior surface 36 of the pole 14 so as to release the cover plate 14 from the pole top end 12.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

We claim:

1. In combination with a tubular hollow pole having an open top end and an interior surface, a pole top cover assembly, comprising:

(a) a substantially flat cover plate having opposite interior and exterior sides, said cover plate at said interior side thereof overlying and seated upon said open top end of said tubular hollow pole, said cover plate having a portion with an aperture formed therethrough open at said opposite interior and exterior sides thereof;

(b) an elongated bracket formed of yieldably resilient, semi-rigid, semi-flexible deformable material and being disposed along said interior side of said cover plate and inside of said open top end of said tubular hollow pole, said bracket having opposite ends and a portion with a hole formed therethrough, said opposite ends of said bracket defining pairs of spaced corners on said bracket; and (c) an elongated member having an elongated shaft portion rotatably mounted through both said aperture of said cover plate and said hole of said bracket, said member being coupled with said portions of said plate and said bracket forming said respective aperture and hole thereof such that rotation of said member in one direction relative to said cover plate and bracket causes said bracket to engage said interior side of said plate and to deform and draw toward said interior side of said cover plate and thereby expand in length and forceably engage solely at said pairs of spaced corners on said opposite ends of said bracket with portions of said interior surface of the hollow tubular pole so as to retain said cover plate on said pole top end, whereas rotation of said member in an opposite direction relative to said cover plate and bracket permits said bracket to engage said interior side of said plate and to reform and retract away from said interior side of said cover plate and thereby contract in length and disengage at said pairs of spaced corners on said opposite ends of said bracket from said portions of said interior surface of said hollow tubular pole so as to release said cover plate from said pole top end;

(d) said elongated member also having an enlarged head portion rigidly attached to one end of said shaft portion and being disposed on said exterior side of said cover plate and outside of said open top end of said tubular hollow pole so as to expose said enlarged head portion for engagement by a tool to selectively rotate said shaft portion of said member in said one or opposite of said directions relative to said cover plate.

2. The assembly as recited in claim 1, wherein said bracket includes a central portion, a pair of opposite intermediate portions connected to and extending in an inclined orientation downwardly and outwardly from opposite ends of said central portion, and a pair of upturned end portions connected to and extending outwardly from opposite ends of said intermediate portions, said central portion being said portion having said hole therethrough, said upturned end portions having said opposite ends of said bracket being engageable with said portions of the interior surface of the hollow tubular pole.

3. The assembly as recited in claim 1, wherein said elongated shaft portion of said member has threads defined externally thereon.

4. The assembly as recited in claim 1, wherein said shaft portion of said member has an outer end with a stop element thereon to prevent decoupling of said bracket therefrom.

5. The assembly as recited in claim 1, wherein said bracket has a generally rectangular configuration.

6. In combination with a tubular hollow pole having an open to end and an interior surface, a pole top cover assembly, comprising:

(a) a generally flat cover plate having opposite interior and exterior sides, said cover plate at said interior side thereof overlying and seated upon said open top end of said tubular hollow pole, said cover plate having a portion with an aperture formed therethrough open at said opposite interior and exterior sides thereof;

(b) an elongated arcuate-shaped bracket formed of yieldably resilient, semi-rigid, semi-flexible deformable material and being disposed along said interior side of said cover plate and inside of said open top end of said tubular hollow pole, said bracket having opposite ends and a portion with a hole formed therethrough, said opposite ends of said bracket defining pairs of spaced corners on said bracket; and (c) an elongated fastener having an elongated shaft portion rotatably mounted through said aperture of said cover plate and said hole of said bracket and having external threads threadably engaged with portions of said plate and bracket forming said respective aperture and hole thereof such that rotation of said externally threaded fastener in one direction relative to said cover plate and bracket causes said arcuate-shaped bracket to engage said interior side of said cover plate and to deform and draw toward said interior side of said cover plate and thereby expand in length and forceably engage solely at said pairs of spaced corners on said opposite ends of said bracket with portions of said interior surface of the hollow tubular pole so as to retain said cover plate on said pole top end, whereas rotation of said externally threaded fastener in an opposite direction relative to said cover plate and bracket permits said arcuate-shaped bracket to engage said interior side of said cover plate and to reform and retract away from said interior side of said cover plate and thereby contract in length and disengage at said pairs of spaced corners on said opposite ends of said bracket from said portions of said interior surface of said hollow tubular pole so as to release said cover plate from said pole top end;

(d) said elongated member also having an enlarged head portion rigidly attached to one end of said shaft portion and being disposed on said exterior side of said cover plate and outside of said open top end of said tubular hollow pole so as to expose said enlarged head portion for engagement by a tool to selectively rotate said shaft portion of said member in said one or opposite of said directions relative to said cover plate.

7. The assembly as recited in claim 6, wherein said arcuate-shaped bracket includes a central portion, a pair of opposite intermediate portions connected to and extending in an inclined orientation downwardly and outwardly from opposite ends of said central portion, and a pair of upturned end portions connected to and extending outwardly from opposite ends of said intermediate portions, said central portion being said portion having said hole therethrough, said upturned end portions having said opposite ends of said bracket being engageable with said portions of the interior surface of the hollow tubular pole.

8. The assembly as recited in claim 6, wherein said elongated shaft portion of said fastener has said threads defined externally thereon.

9. The assembly as recited in claim 8, wherein said shaft portion of said fastener has an outer end with a stop element thereon to prevent decoupling of said bracket therefrom.

10. The assembly as recited in claim 9, wherein said bracket has a generally rectangular configuration.

* * * * *